US008572964B2

(12) United States Patent
Gärtner et al.

(10) Patent No.: US 8,572,964 B2
(45) Date of Patent: Nov. 5, 2013

(54) METHOD FOR RECUPERATING ENERGY FROM AN EXHAUST GAS FLOW AND MOTOR VEHICLE

(75) Inventors: Jan Gärtner, Sindelfingen (DE); Thomas Koch, Böblingen (DE); Jozsef Marton Mercz, Schwäbisch Gmünd (DE); Jozsef Mercz, legal representative, Schwäbisch Gmünd (DE); Piroska Merczne, legal representative, Schwäbisch Gmünd (DE)

(73) Assignee: Daimler AG, Stuttgart (DE)

( * ) Notice: Subject to any disclaimer, the term of this patent is extended or adjusted under 35 U.S.C. 154(b) by 254 days.

(21) Appl. No.: 12/807,454

(22) Filed: Sep. 3, 2010

(65) Prior Publication Data

US 2011/0056203 A1 Mar. 10, 2011

Related U.S. Application Data

(63) Continuation-in-part of application No. PCT/EP2009/001287, filed on Feb. 24, 2009.

(30) Foreign Application Priority Data

Mar. 6, 2008 (DE) ..... 10 2008 012 907

(51) Int. Cl.
*F02G 3/00* (2006.01)

(52) U.S. Cl.
USPC ..... 60/616; 60/614; 60/615

(58) Field of Classification Search
USPC ..... 60/616, 614, 615
See application file for complete search history.

(56) References Cited

U.S. PATENT DOCUMENTS

| | | | | |
|---|---|---|---|---|
| 7,007,473 | B2 * | 3/2006 | Nagatani et al. | 60/616 |
| 2006/0060166 | A1 | 3/2006 | Huang | |

FOREIGN PATENT DOCUMENTS

| | | |
|---|---|---|
| CH | 310325 | 12/1955 |
| CN | 1246911 | 3/2000 |
| CN | 1526925 | 9/2004 |
| DE | 34 28 626 | 2/1988 |
| DE | 196 34 108 | 8/1997 |
| DE | 195 05 725 | 8/1998 |
| EP | 0 370 216 | 5/1990 |
| EP | 0 446 577 | 1/1991 |
| EP | 1 333 157 | 8/2003 |
| EP | 1 431 523 | 6/2004 |
| EP | 1 536 104 | 6/2005 |
| FR | 2 884 555 | 10/2006 |
| JP | 2004052738 | 2/2004 |

* cited by examiner

*Primary Examiner* — Ching Chang
(74) *Attorney, Agent, or Firm* — Klaus J. Bach

(57) ABSTRACT

In a motor vehicle with an internal combustion engine providing a hot exhaust gas flow which is used as heat source for a Clausius-Rankine cycle process, wherein a pump is provided in the cycle for pumping, pressurizing and circulating an operating fluid, the pumping operation is controlled by a controller depending on the exhaust gas mass flow through an evaporator and possibly also the exhaust gas temperature to vaporize the operating fluid and expanding the vapor under pressure in an expander while generating energy. The vapor is condensed in a condenser to form a condensate which is again returned to the pump.

4 Claims, 1 Drawing Sheet

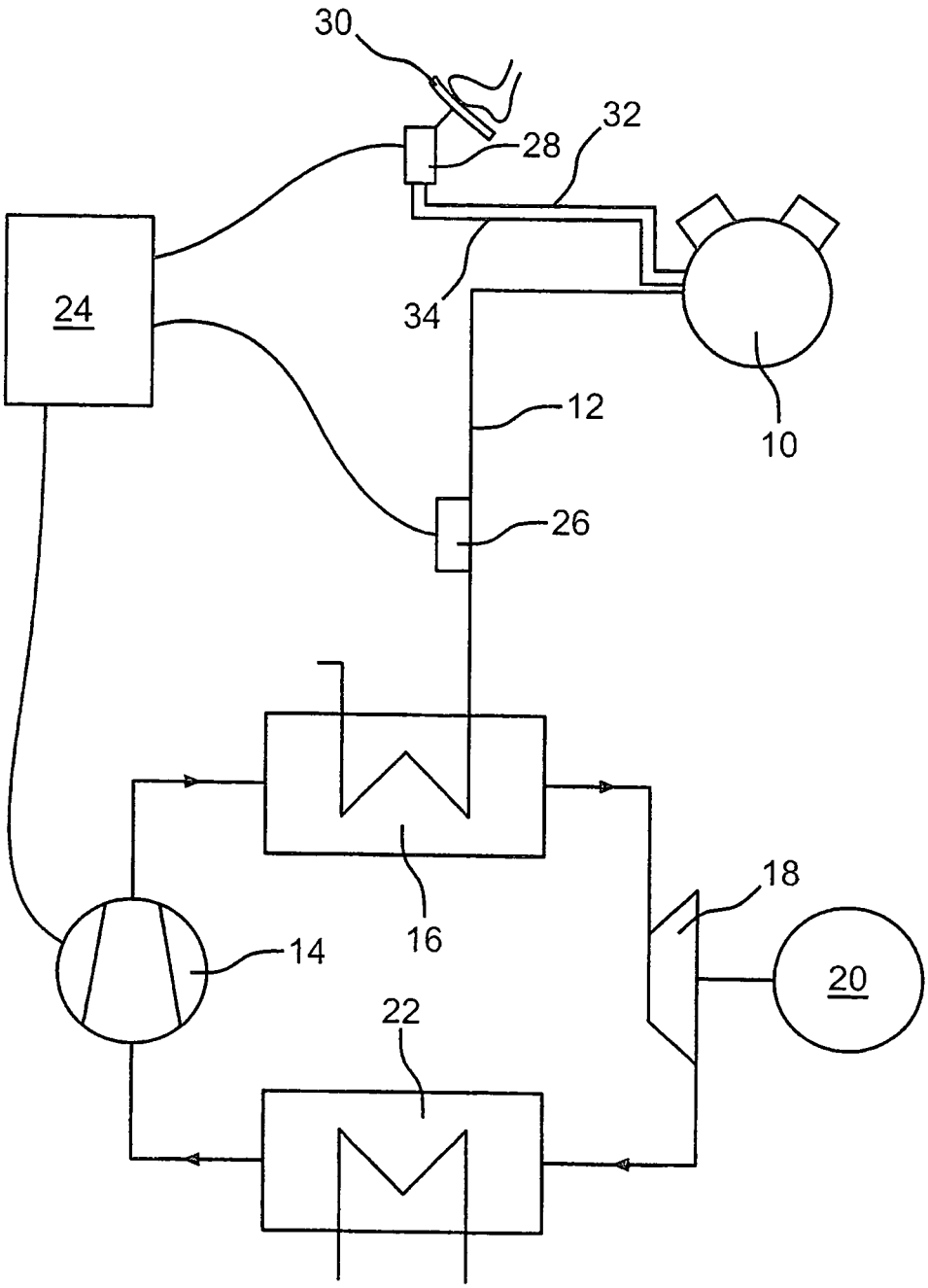
30
32
28
24
34
12
10
26
16
18
14
20
22

METHOD FOR RECUPERATING ENERGY FROM AN EXHAUST GAS FLOW AND MOTOR VEHICLE

This is a Continuous-In-Part application of pending international patent application PCT/EP2009/001287 filed Feb. 24, 2009 and claiming the priority of German patent application 10 2008 012 907.0 filed Jun. 3, 2008.

BACKGROUND OF THE INVENTION

The invention relates to a method for recuperating energy from an exhaust gas flow of an internal combustion engine and a motor vehicle, in which such an exhaust gas flow is available and can thus be used to recuperate heat therefrom.

The exhaust gas coming from an internal combustion engine has a high temperature and contains heat energy which could be recuperated for example in the form of electrical energy via a so-called Clausius-Rankine cycle. Herein, a working fluid usually water, is alternately evaporated at a high pressure and condensed at a low pressure. The high pressure is reduced in an expansion machine, in particular a turbine, while generation work, so that electrical energy can be obtained. After condensation in a condenser, the working fluid, which is now liquid, is pressurized by means of a pump and supplied to an evaporator. There, the liquid working fluid is heated by another fluid via indirect heat transfer, in which the other fluid is separated from the working fluid via a heat conductive wall. It is conceivable that the other fluid is the exhaust gas of the internal combustion engine. Up to now there are however difficulties for the realization in that the exhaust gas mass flow is variable and depends in particular on the momentary performance of the internal combustion engine. It is thus not sensible to circulate the working fluid in the Clausius-Rankine cycle at a constant volumetric flow. A mass flow control of the working fluid was already considered, which should take place in dependence on measuring values obtained at the working fluid, e.g. in dependence on temperature and mass flow or pressure of the working medium. Due to the inertness of such a control, which is caused by the relation of the internal volume of the evaporator to the mass flow, a stable control of the type mentioned has proved to be impossible.

In EP 1 333 157 A1, it is indeed described that the exhaust gas flow from an internal combustion engine is used as energy source for a Clausius-Rankine cycle. Two circuit systems are provided hereby, where the working fluids are distinguished from each other by their boiling point. The pump capacity can be adjusted in a variable manner in at least one of the circuits. In EP 1 333 157 A1 it is stated that the efficiency of the recovery of heat energy from the exhaust gas flow can be adjusted in a maximum manner.

It is the object of the present invention to provide a method for obtaining energy from an internal combustion engine, which can be implemented in a practical but relatively simple manner.

SUMMARY OF THE INVENTION

In a motor vehicle with an internal combustion engine providing a hot exhaust gas flow which is used as heat source for a Clausius-Rankine cycle process, wherein a pump is provided in the cycle for pumping, pressurizing and circulating an operating fluid, the pumping operation is controlled by a controller depending on the exhaust gas mass flow through an evaporator and possibly also the exhaust gas temperature to vaporize the pressurized operating fluid and expanding the vapor in an expander while generating energy. The vapor is condensed in a condenser to form a condensate which is again returned to the pump.

According to the invention, a Clausius-Rankine cycle is used for obtaining energy from an exhaust gas flow, wherein heat energy from the exhaust gas flow is supplied to the working fluid. The capacity of the pump is controlled in dependence on at least one variable representing respectively the heat energy transferred by the momentary exhaust gas flow in the evaporator per unit of time; that is the pump capacity is changed with the time.

The invention is based on the recognition that a control based on cycle internal variables is not necessary, if the amount of the liquid working fluid supplied to the evaporator can be adapted to the momentary exhaust gas flow. If the exhaust gas flow provides more heat energy, the capacity of the pump can be increased and if the exhaust gas flow provides less heat energy, the capacity of the pump can be decreased. The provided heat energy is directly proportional to the exhaust gas mass flow so that the capacity of the pump is preferably controlled depending on at least an exhaust gas mass flow. In particular a performance graph for a variable representative of the capacity of the pump in dependence on the exhaust gas mass flow can be used for an adjustment of the pump performance. The exhaust gas temperature is preferably also considered. In this case, a performance graph is preferably used which represents a variable representative of the capacity of the pump in dependence on the exhaust gas mass flow and the exhaust gas temperature.

The exhaust gas mass flow can be measured in a simple manner and the measuring signal can be supplied to a controller, which controls the pump. The exhaust gas mass flow however does not need to be based on the momentary measuring value. The exhaust gas mass flow may actually be determined based on the operation of the internal combustion engine. One or several variables representative of the operation of the internal combustion engine can thus be determined, and a performance graph can be provided for the internal combustion engine (when using only one variable of a characteristic), which represents the dependence of the exhaust gas mass flow on this variable. The exhaust gas mass flow can in this way be determined from the performance graph and the capacity of the pump can be adjusted in dependence on the exhaust gas mass flow estimated in this manner.

However, generally, the capacity of the pump is determined directly by the speed of the pump.

The invention provides a motor vehicle with an internal combustion engine wherein a single Clausius-Rankine cycle is used. This is made possible with a pump whose capacity can be adjusted, the adjustment of the pump capacity being based on signals from a controller. The controller is designed to control the capacity of the pump in dependence on at least one variable which is representative of the heat energy transferred by the momentary exhaust gas flow in the evaporator per unit of time.

The exhaust gas mass flow and possibly additionally also the temperature of the exhaust gas is used as input value for the control of the pump.

If the exhaust gas mass flow is determined based on a performance graph, the controller has to obtain signals which provide values indicative of the operation of the internal combustion engine. The operation of the internal combustion engine is determined on the one hand by the amount of fuel that is injected and on the other hand by the amount of air supplied to the engine. The control is thus preferably coupled to a source signal indicating the position of a gas pedal. With an electronically operating gas pedal, this source can be a sensor which directly determines the position of the gas pedal. The signals of the sensor are then also supplied to a controller, which controls the internal combustion engine (or the fuel and air supply thereto). With a mechanical system, the position of the gas pedal can be determined based on gas flow, so that the above-mentioned source for the signals can comprise a gas flow measuring device.

The invention will become more readily apparent from the following description thereof with reference to the accompanying drawing.

BRIEF DESCRIPTION OF THE DRAWINGS

The sole FIGURE shows schematically the components of a motor vehicle used in a method according to the invention.

DESCRIPTION OF A PARTICULAR EMBODIMENT

The motor vehicle according to the invention comprises an internal combustion engine 10, in which fuel is combusted, whereby hot exhaust gas is generated, which is discharged via an exhaust gas line 12. The hot exhaust gas in the exhaust gas line 12 is now used as an energy source for a Clausius-Rankine cycle. A working fluid, presently preferably water, is circulated in such a cycle in a closed system. The water is pressurized by a pump 14 and is pumped in a liquid state by the pump 14 to an evaporator 16 where heat energy is transferred from the exhaust gas to the water so that it evaporates under a high pressure. The pressurized water vapor is conducted to a turbine 18, which is coupled to a generator 20. The water vapor expands when passing through the turbine 18 and the work performed hereby is converted to electrical energy by the generator 20. After passing through the turbine 18, the water vapor is condensed to water in a condenser 22, wherein heat is transferred to a suitable coolant. The coolant may also be water like the working fluid of the Rankine cycle. In the condenser 22 the coolant is separated from the working fluid by a heat transfer wall. This water coolant can be conducted to the cooler of the motor vehicle. The working fluid water is returned from the condenser 22 to the pump 14.

A maximum mass flow of the working fluid can be determined with a given exhaust gas mass flow and a given exhaust gas temperature, which can be evaporated in the evaporator 16 under these conditions. It is thus not reasonable to let the pump run with a constant speed, as a part of the liquid working medium supplied by the pump 14 to the evaporator 16 would not be evaporated when a low exhaust gas mass flow or a low exhaust gas temperature is present. Or, with a high exhaust gas mass flow and a relatively high exhaust gas temperature, the maximum available energy would not be extracted. It is therefore provided that the speed of the pump 14 can be adjusted in a variable manner, that is, the speed of the pump 1, is controlled via a controller 24. The controller 24 is designed to ensure that as much heat energy as possible is transferred from the exhaust gas flow to the working fluid. This presently takes place in dependence on the exhaust gas mass flow and exhaust gas temperature. The controller 24 can herein in particular use a performance graph which has stored therein the speed of the pump as a function of the exhaust gas mass flow and exhaust gas temperature. As the control takes place in dependence on the variable exhaust gas mass flow and exhaust gas temperature, the controller 24 has to be supplied with corresponding information signals. A suitable measuring device 26 can be provided in or at the exhaust gas line 12, which measures the exhaust gas mass flow and also the exhaust gas temperature. A sensor 28 can also sense the position of a gas pedal 30 of the motor vehicle, via which the amount of fuel which is supplied to the internal combustion engine 32 via an injection line, and the amount of air which is supplied to the internal combustion engine 10 via a line 34, are determined. The position of the gas pedal 30 thus determines the operation of the internal combustion engine 10. The exhaust gas mass flow is directly dependent on the position of the gas pedal 30, and the engine speed and partially also the exhaust gas temperature can be directly measured. The controller can determine, due to the signals from the sensor 28, how large the exhaust gas mass flow or the exhaust gas temperature is. suitable characteristic values or performance graphs are recorded in the controller 24 so that a relation of the position of the gas pedal 30 to the exhaust gas mass flow can be established. It is a practicable solution, if the exhaust gas mass flow is estimated on the basis of the position of the gas pedal 30, and if the temperature of the exhaust gas flow is determined by the sensor 26.

The system according to the invention provides for a reliable and stable operation of the Clausius-Rankine cycle in particular also during transient procedures. The system can also be integrated into an existing standard system in a simple manner. As controller 24, for example the engine controller 10 may be used.

What is claimed is:

1. A method for recuperating energy from an exhaust gas flow of an internal combustion engine (10) of a motor vehicle, said method comprising the steps of: supplying the exhaust gas flow to en evaporator (16), in which a liquid working fluid under pressure is vaporized due to the transfer of heat from the exhaust gas flow to the working fluid, supplying the gaseous working fluid to en expansion machine (18) where the gaseous work fluid is expanded and where energy is obtained, and conducting the gaseous working fluid then to a condenser (22) for condensation therein to bring it back to the liquid state (Rankine cycle), and supplying the liquid working fluid to a pump (14) for pressurizing the liquid fluid before it is again supplied to the evaporator (16) by the pump (14), the pump (14) having a variable speed which is controlled based in dependence on a measured momentary exhaust as mass flow in combination with a variable representing the heat energy transferred by the momentary exhaust gas mass flow to the evaporator as determined with the aid of a performance graph established on the basis of exhaust gas temperature and exhaust gas mass flow values for the various engine operating conditions.

2. The method according to claim 1, wherein the pumping volume of the pump (14) is adjusted based on the momentary exhaust gas mass flow and a temperature of the exhaust gas in the exhaust gas line of the internal combustion engine.

3. A motor vehicle including an internal combustion engine (10), from which a flow of hot exhaust gas is discharged and an energy recuperating system comprising a Clausius-Rankine cycle including a pump (14) for pressurizing a working fluid, an evaporator (16) heated by the hot exhaust gas to vaporize the pressurized working fluid, an expansion machine (18), in which the pressurized vaporized working fluid is expanded to generate energy, a condenser (22) for condensing the expanded working fluid to form condensate which is returned to the pump (14), the pump (14) being controllable for pumping speed adjustment and pumping volume control thereof, and a controller (24) for adjusting a pump capacity on the basis of control signals in dependence on a measured momentary exhaust as flow and a variable representing the heat energy transferred to the pressurized working fluid by exhaust gas flowing through the evaporator (16) as determined with the aid of a performance graph established on the basis of the exhaust gas temperature predetermined and recorded based on the exhaust gas mass flow values.

4. A motor vehicle according to claim 3, wherein the controller is coupled to a source (28) for signals indicating the position of a gas pedal (30) of the motor vehicle.

* * * * *